US008567743B2

(12) United States Patent
Ehrhardt et al.

(10) Patent No.: US 8,567,743 B2
(45) Date of Patent: Oct. 29, 2013

(54) SYSTEM FOR ATTACHING COLUMN TO A STRUCTURAL SUPPORT

(76) Inventors: Joseph Phillip Ehrhardt, Leonardo, NJ (US); Miguel Gonzales, Stafford, TX (US)

( * ) Notice: Subject to any disclaimer, the term of this patent is extended or adjusted under 35 U.S.C. 154(b) by 146 days.

(21) Appl. No.: 12/924,981

(22) Filed: Oct. 12, 2010

(65) Prior Publication Data

US 2011/0084186 A1 Apr. 14, 2011

Related U.S. Application Data

(63) Continuation-in-part of application No. 12/214,919, filed on Jun. 25, 2008, which is a continuation-in-part of application No. 11/407,240, filed on Apr. 20, 2006, now abandoned.

(51) Int. Cl.
*E02D 27/00* (2006.01)

(52) U.S. Cl.
USPC ..... 248/534; 248/530; 52/296

(58) Field of Classification Search
USPC ..... 248/530, 534, 539, 156; 52/296, 297, 52/298
See application file for complete search history.

(56) References Cited

U.S. PATENT DOCUMENTS

| | | | | |
|---|---|---|---|---|
| 3,514,911 | A * | 6/1970 | Preradovich | 52/165 |
| 4,429,497 | A * | 2/1984 | Dibernardi | 52/27 |
| 5,505,033 | A * | 4/1996 | Matsuo et al. | 52/296 |
| 5,568,909 | A * | 10/1996 | Timko | 248/519 |
| 6,324,800 | B1 * | 12/2001 | Valentz et al. | 52/298 |
| 6,336,620 | B1 * | 1/2002 | Belli | 248/519 |
| 6,513,291 | B2 * | 2/2003 | Gilsdorf | 52/297 |
| 6,729,089 | B1 * | 5/2004 | Spragg | 52/296 |

* cited by examiner

*Primary Examiner* — Terrell McKinnon
*Assistant Examiner* — Steven Marsh
(74) *Attorney, Agent, or Firm* — Thomas J. Germinario

(57) ABSTRACT

A system for attaching a columnar building member to a structural support member, uses one or more connecting brackets comprising a flat base plate having an inner perimeter and an outer perimeter, with a plurality of apertures disposed along the base plate. A socket extends from the inner perimeter of the base plate, with the perimeter of the socket conforming to the inner perimeter of the base plate, and with a plurality of apertures disposed along the socket. The columnar building member is attached to the connecting bracket via a plurality of fastening means through the apertures disposed along the socket. The columnar building member and connecting bracket are attached to the structural support member (s) via a plurality of fastening means through the apertures disposed along the base plate.

2 Claims, 9 Drawing Sheets

SYSTEM FOR ATTACHING COLUMN TO A STRUCTURAL SUPPORT

REFERENCE TO RELATED PATENT APPLICATIONS

The present application is a continuation-in-part of U.S. application Ser. No. 12/214,919, filed on Jun. 25, 2008, which is, in turn, a continuation-in-part of U.S. application Ser. No. 11/407,240, filed on Apr. 20, 2006 now abandoned.

BACKGROUND OF THE INVENTION

The present invention relates generally to brackets or connectors for building materials, and more particularly to a connecting bracket providing a comprehensive positive connection between a support column and a slab, pier, girder or structural frame of a building.

With the escalating costs of building materials, especially lumber, many companies have developed pre-engineered polymer and fiberglass materials for use as support structures in commercial and residential construction.

At the same time, the monumental costs for rebuilding inferior structures after natural disasters has caused communities to enact tougher building codes and standards to minimize damage from future natural disasters, thereby hopefully lowering replacement costs and saving lives.

Accordingly, building designers and engineers must now factor both cost and safety requirements into their new designs.

In particular, hollowed polymer and fiberglass columns are used extensively for porches, porticos, decks, as well as interior design appurtenances. A problem arises when a contractor seeks to secure these columns to the structural counterparts they transfer the loads to. While the particular column manufacturing company typically supplies a technical data sheet for installation, such data sheets are often incomplete, or provide minimal guidelines. Frequently, the contractor is instructed to check with local state and/or federal building codes for proper installation. In a bit of circular logic, many of the building codes themselves (e.g., the International Building Code or IBC) will state that a product should be installed in accordance with the manufacturer's product specification.

Left with minimal guidance and subjective standards, many contractors/installers resort to ad hoc or self-created connection mechanisms, with the result that such structures are not in compliance with building codes, and are inadequate to properly withstand the wind, seismic or other destructive forces experienced in natural disasters.

For example, as shown in FIGS. 1A and 1B, installers generally use "L" shaped brackets 90 to connect the support column 80 to wherever they can get an attachment point on the structural frame 95. In some cases, there may be three (or more) attachment points, but in other cases there are two attachment points, and in egregious cases, only one attachment point. The attachments points are usually covered with a decorative collar, so it is difficult for anyone to determine the structural integrity of the project.

In any case, these "L" brackets provide limited axial load support, load transfer, lateral support and shear value from the column 80 to the structural counterpart 95. These concentrated point connections do not transfer the load around the entire circumference of the column, severely reducing the load transfer capabilities for wind, snow, seismic and lateral forces.

In another typical installation shown in FIG. 2, a lag bolt 140 or concrete bolt is fastened to the end of a strap or cable

145. This device is threaded through the hollow column 80 and then secured to the structural component above the column. This method limits the lateral impact to the column and is also harder to install. That is because the process involves jacking (in the direction denoted by the arrow 150) of the upper load to slide the structural hollow column 80 into its final location.

What is needed, therefore, is a connecting bracket that provides a shear connection around the entire circumference or perimeter of the column. What is also needed is a device that can connect and transfer the loads efficiently and with stronger lateral integrity.

SUMMARY OF THE INVENTION

To overcome the above described and other disadvantages of the prior art, the present invention provides for a collar-type connecting bracket with two components: a socket for attaching a support column to the connecting bracket, and a base plate for attaching the connecting bracket to one or more structural members.

More specifically, the present invention provides for a connecting bracket, for attaching a columnar building member to a structural support member, including a flat base plate having an inner perimeter and an outer perimeter, with a plurality of apertures disposed along the base plate. A socket extends from the inner perimeter of the base plate, with the perimeter of the socket conforming to the inner perimeter of the base plate, and with a plurality of apertures disposed along the socket. The columnar building member is attached to the connecting bracket via a plurality of fastening means through the apertures disposed along the socket. The columnar building member and connecting bracket are attached to the structural support member(s) via a plurality of fastening means through the apertures disposed along the base plate.

BRIEF DESCRIPTION OF THE DRAWINGS

The above objects and other advantages of the present invention will become more apparent by describing in detail the preferred embodiments thereof with reference to the attached drawings in which.

DETAILED DESCRIPTION OF PREFERRED EMBODIMENTS

The present invention will now be described more fully with reference to the accompanying drawings, in which preferred embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Broadly described, an embodiment of the invention provides a means for connecting a support column to a slab pier, girder or structural frame of a building. Support columns used in construction today may be hollow or not, but the connecting bracket of the present invention can be used with any support column installation.

Figure 3:
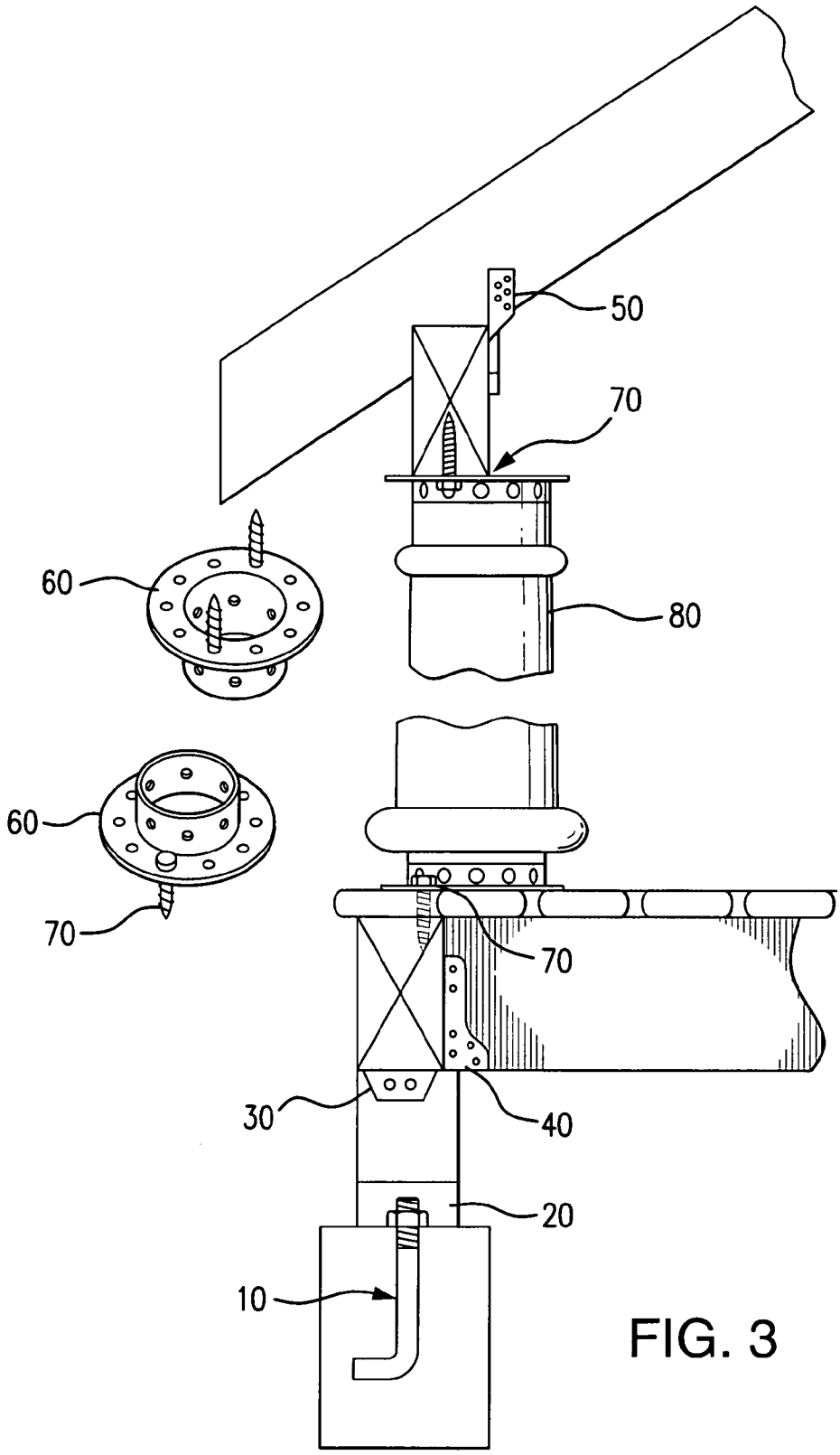
FIG. 3 is a side view and partial cross-sectional view illustrating the a load path and employing the novel connecting bracket disclosed herein.

FIG. 3 depicts a load path employing the connecting bracket 60 disclosed herein. The International Building Code (IBC) describes a load path as in FIG. 3 where the individual framing members are not continuous from the foundation sill to the roof. In such instances, the framing members must be secured to ensure a continuous load path. Foundation anchors 10, post-foundation anchors 20, post to girder brackets 30, floor joist hangers 40, and hurricane clips 50, address many wood-to-wood and wood-to-masonry connections.

The connecting bracket 60 of the present invention provides a positive, secure and circumferential connection between the respective upper or lower ends of the support column 80 and the slab, pier, girder or other structural component. The connecting bracket 60 is designed to provide a connection that meets or exceeds the building code requirements, while still making it easier and quicker to install than existing methods and apparatus. The connecting bracket 60 can be used to secure any type of material, including but not limited to wood, polymer and aluminum materials. The connecting bracket 60 is secured to the column 80 and the structural member using a suitable fastening means 70, for example, nails, screws, lag bolts, nut/bolt combinations and other equivalent means.

Figure 4A:
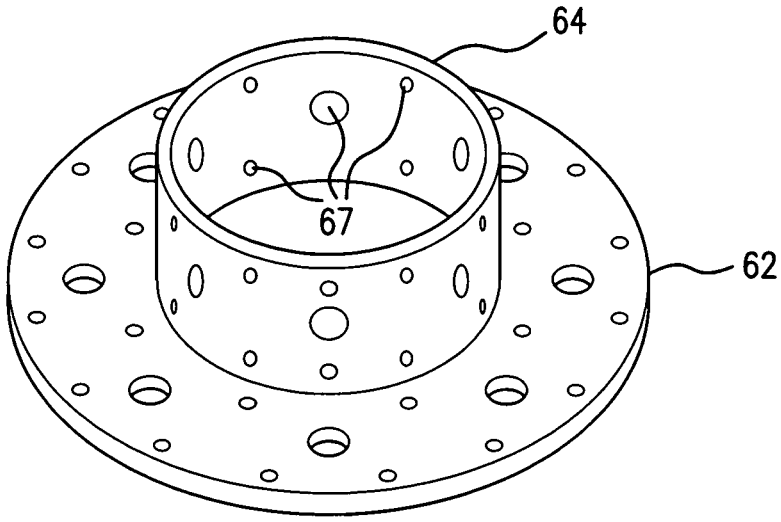
FIG. 4A is a more detailed perspective view of the connecting bracket illustrated in FIG. 3.
Figure 4B:
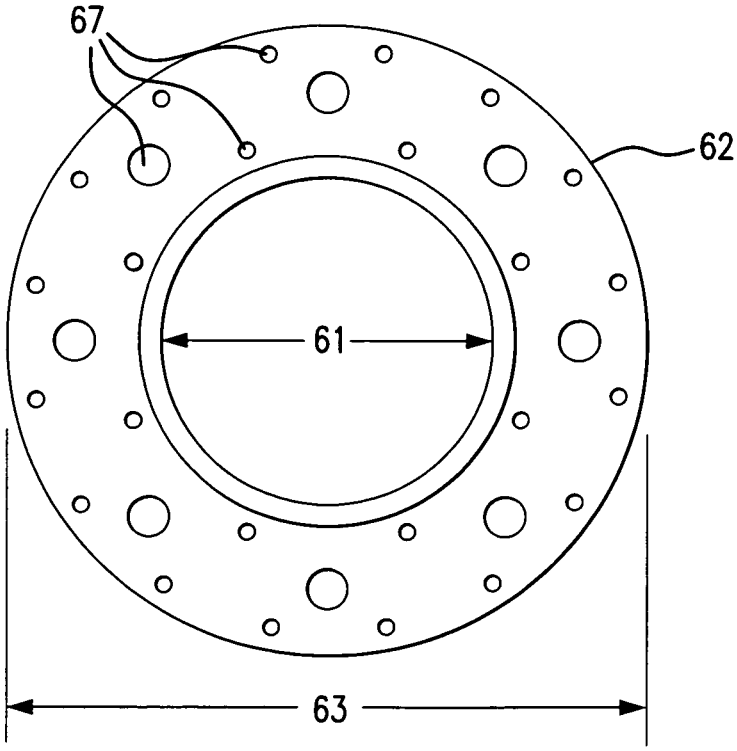
FIG. 4B is a bottom view of the connecting bracket in FIG. 4A.

FIGS. 4A and 4B provide a more detailed perspective view and bottom view, respectively, of the connecting bracket 60 of the present invention. The connecting bracket 60 comprises a flat base plate 62 integrated with a socket 64. The inner perimeter 61 of the base plate 62 conforms to the outer perimeter of the support column 80 to which it will be attached.

Figure 4C:
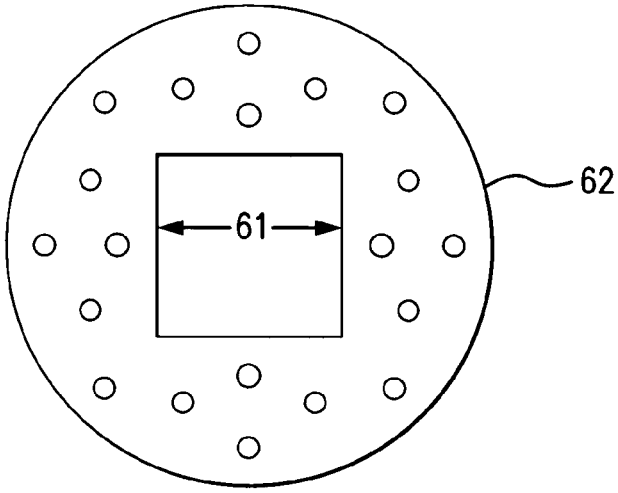
FIGS. 4C, 4 D and 4 E illustrate bottom and perspective views of alternate embodiments of the connecting bracket.

While shown in a circular, collar-type configuration in FIGS. 4A and 4B, the invention is not limited thereto. One of ordinary skill in the art would understand that other connecting bracket shapes are contemplated that would conform to the shape of the column, for example, square, rectangular, triangular, octagonal, etc. In any of such cases, the inner diameter or perimeter 61 of the base plate 62 and socket 64 is what conforms to the outer diameter or perimeter of the support column 80 (see FIG. 4C).

Figure 4D:
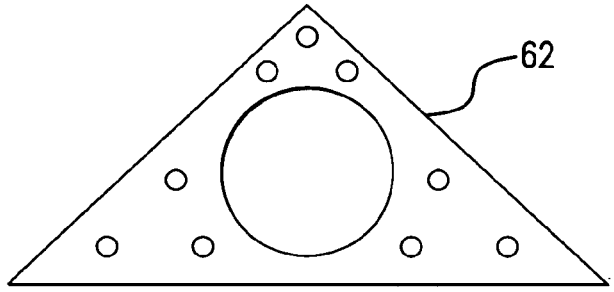

The outer perimeter 63 of the base plate 62 may be of a different shape to conform to a specific location of the structural support members to which it will be secured. For example, if attaching a cylindrical column 80 at a corner structural location, the outer perimeter 63 of the base plate 62 may be triangular, while the inner diameter 61 would be circular to conform to the circumference of the column 80 (see FIG. 4D).

Figure 4E:
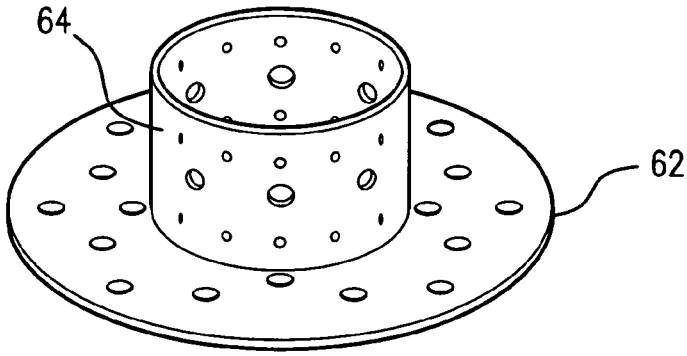

While FIG. 4A illustrates a perpendicular socket 64, the invention is not limited thereto. The socket 64 may be oriented at any angle to conform to any required non-perpendicular support installation requirements (see FIG. 4E).

Figure 5A:
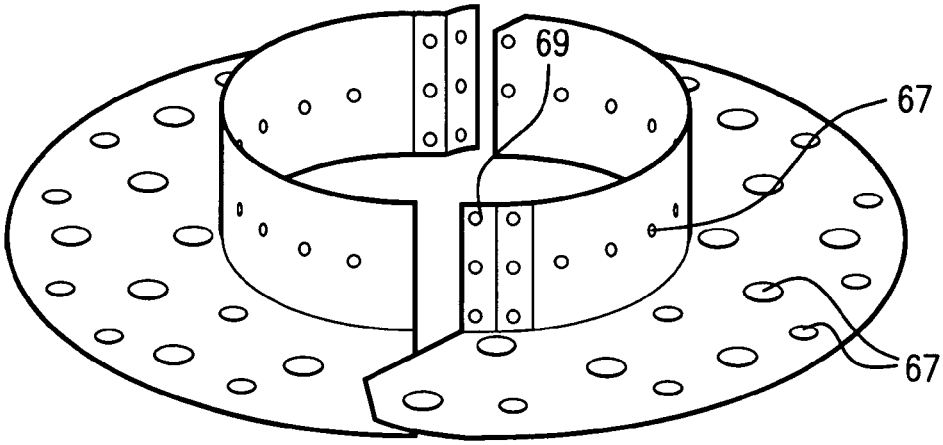
FIGS. 5A and 5B are alternate embodiments of the connecting brackets of FIGS. 4A and 4B, depicting multiple-piece construction.
Figure 5B:
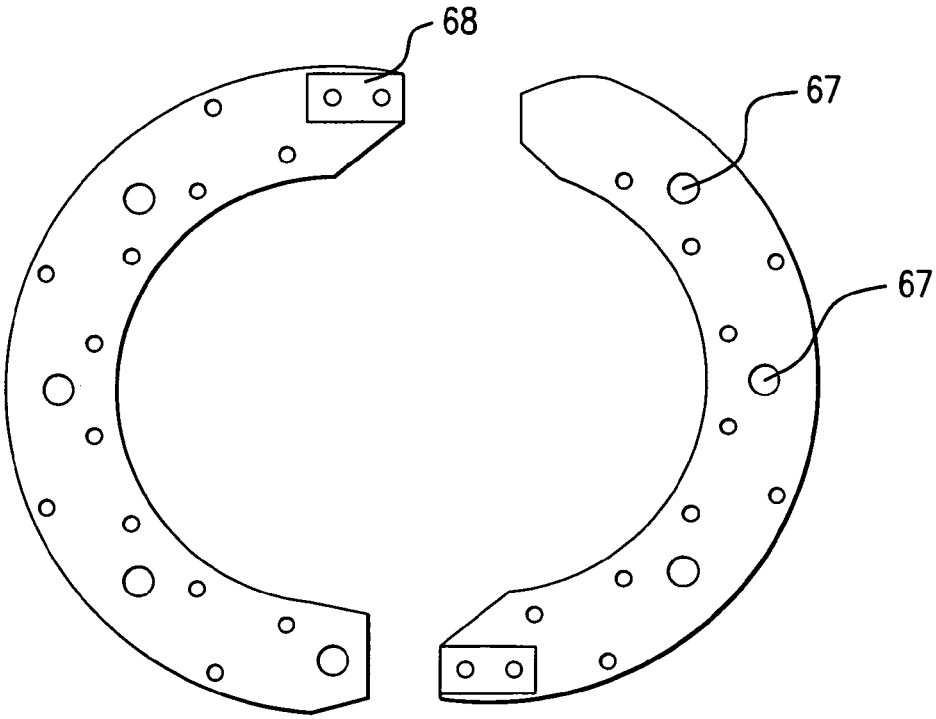

Also, the connecting bracket 60 shown in FIG. 4A is comprised of one-piece construction. However, the bracket can be manufactured in more than one piece as shown in FIGS. 5A and 5B. The pieces then can be mated after positioning the bracket in place, at both the base plat joint 68 (in FIG. 5B) and the socket joint 69 (in FIG. 5A). Lag bolts, nails, shear screws and similar fastening means could be used to mate the two sections. Such an embodiment would facilitate retrofitting or replacing existing columnar connections without having to remove and reinstall the support column 80. One of ordinary skill in the art would understand that the pieces may also overlap at a single junction, or as shown in FIGS. 5A and 5B, at multiple overlapping junction points 68 and 69 to securely adapt to the perimeter of the column.

In each of FIGS. 4 and 5, a plurality of apertures 67 of various sizes and spacing are provided along the base plate 62 and socket 64, not just at certain discrete points dictated by the manufacturer. This flexibility to choose the precise attachment point enables the installer to secure and transfer the load path at optimum points around the entire perimeter of the structural column. This assures the installer always has a positive connection using a nail, screw shear, lag bolt, nut and bolt, or other equivalent fastening means 70. This attachment point flexibility is equally applicable to the connection between the socket 64 of the connecting bracket 60 and the support column 80, and the base plate 62 of the connecting bracket 60 and the support structure.

Figure 7:
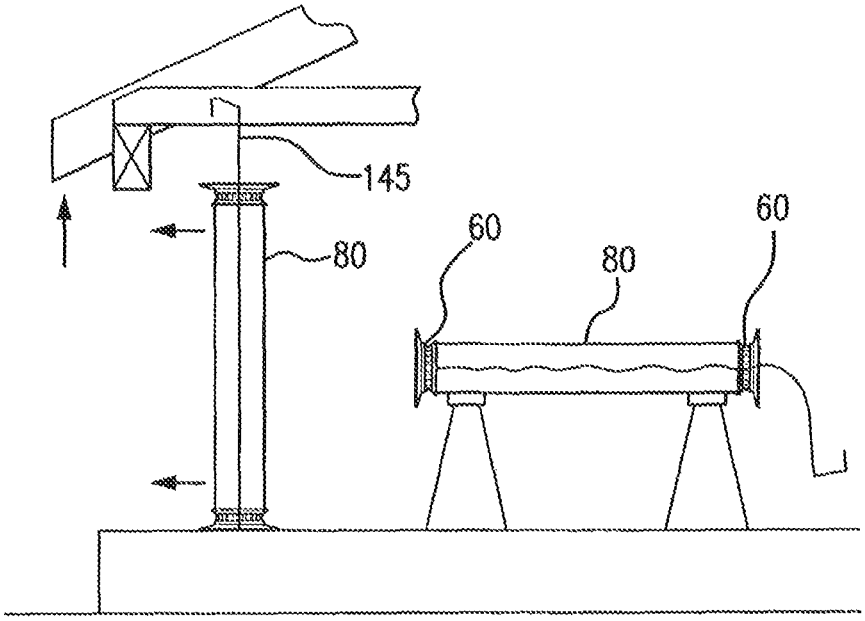
FIG. 7 is a side view of a method for mating the connecting brackets to a support column prior to positioning the support column for attachment.
Figure 6B:
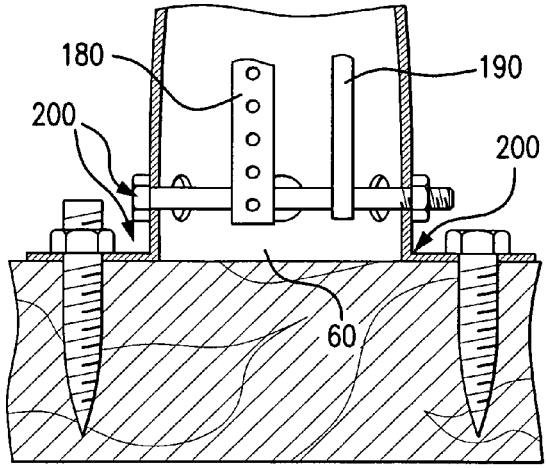
FIGS. 6A and 6B illustrate a perspective view and detailed side view, respectively, of the connecting bracket with additional reinforcing straps or cables attached.
Figure 6A:
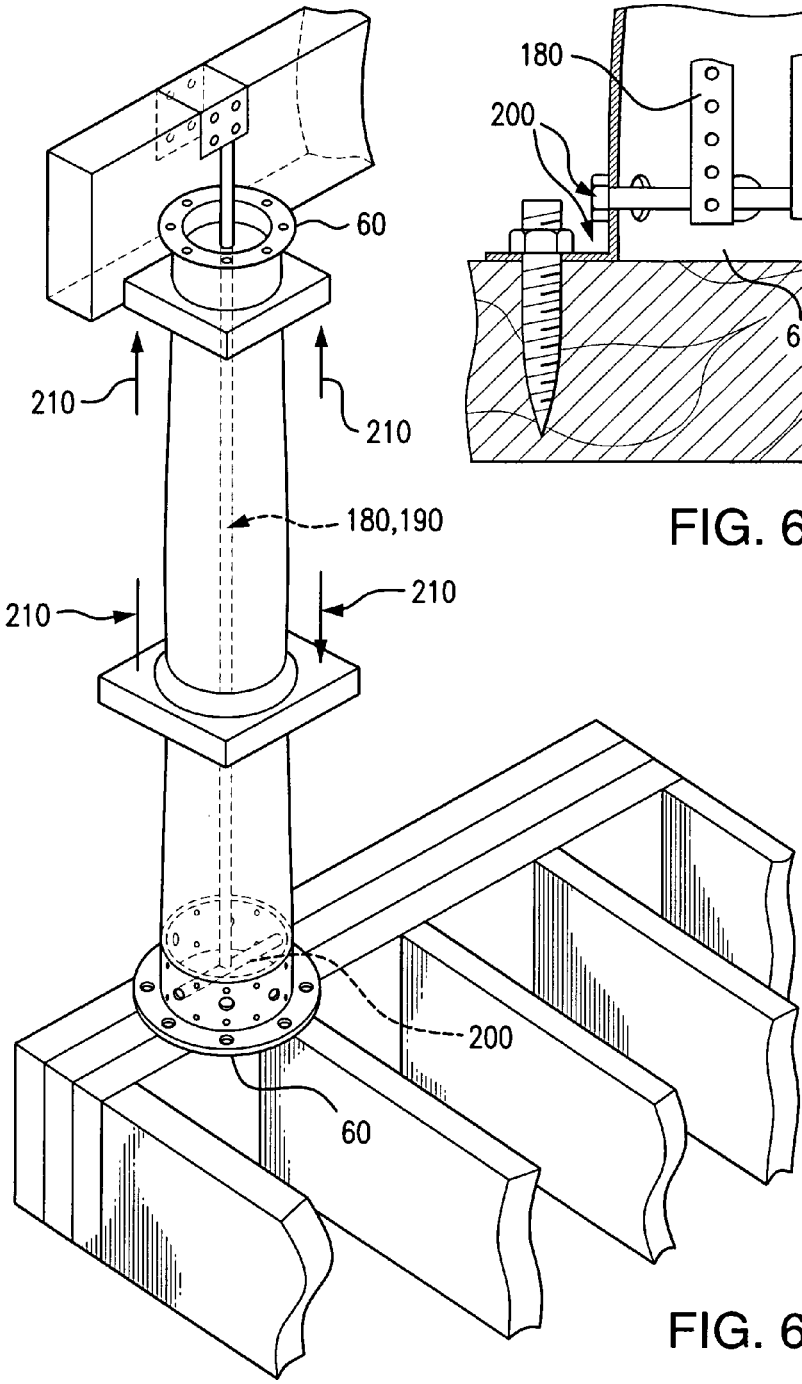

In addition, as shown in FIGS. 6A and 6B, the connecting bracket 60 can be used in conjunction with other straps 200 or cables 180 and 190, to provide additional load points to counteract larger contemplated seismic or wind loads. Since the connector bracket 60 conforms to the outer perimeter of the column 80, the load is transferred more proportionally around the column perimeter. The plurality of apertures 67 provide the installer with flexibility to attached the additional straps 200 or cables 180 and 190 at precise locations to ensure optimum load transfer. FIG. 7 illustrates one convenient way to install the connecting bracket 60 when the column 80 is on a horizontal work surface. The connecting brackets 60 are merely slid into place at either end of the column 80, after which the column 80 is vertically positioned in place for attachment.

As described herein, the connecting bracket 60 can be used to install and secure the attachment point between similar or dissimilar building materials, whether conventional wood and aluminum, or modern polymers and fiberglass. The connecting bracket 60 also facilitates inspection and maintenance of the structural attachment point.

The connecting bracket 60 can be made of many different materials and material thicknesses, depending on the end use, environmental factors, and the anticipated load. For example, the connecting bracket 60 can be manufactured with all gauges of stainless steel, hot-dipped zinc-coated galvanized steel, silicone, bronze, copper, fiberglass and plastics.

Figure 8:
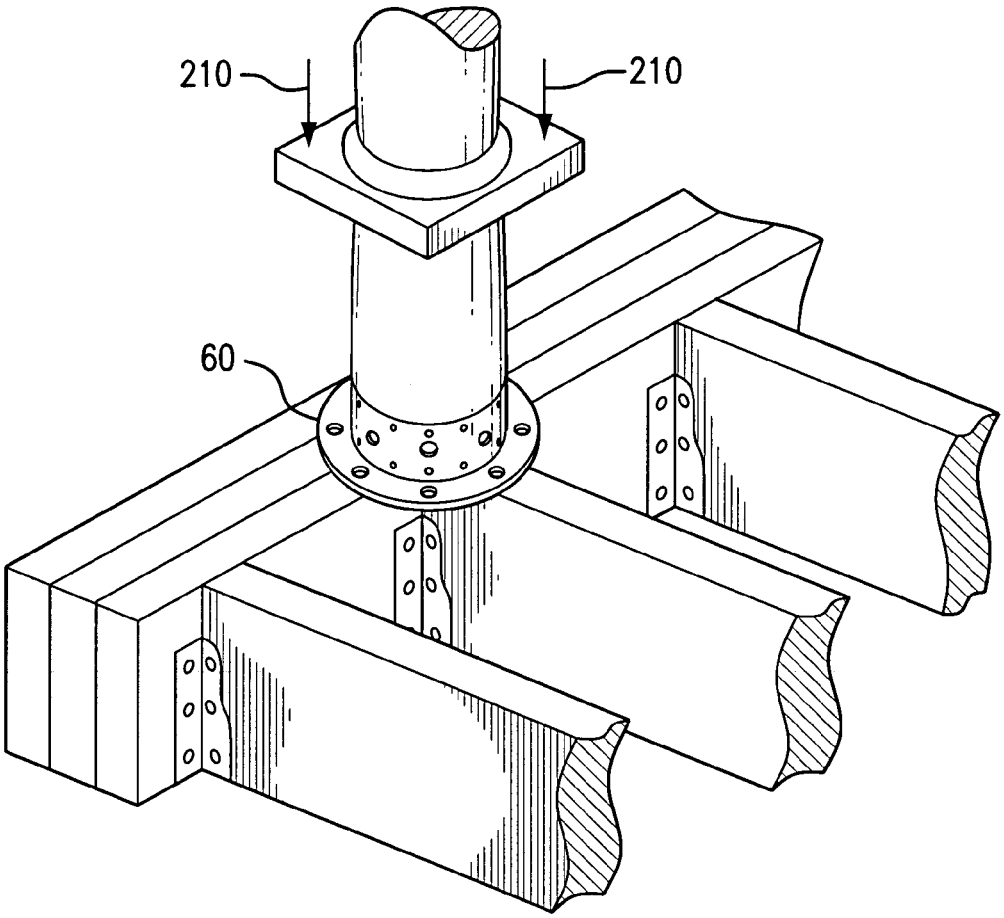
FIG. 8 is a perspective view of a decorative base covering the connecting bracket of the present invention.

The vertical height and horizontal width of the bracket should be dimensioned to ensure the decorative base 210 (see FIG. 8) of the column 80 adequately covers the connecting bracket 60 so that it remains inconspicuous. The vertical height and horizontal width of the bracket are also dimensioned to ensure the installer has sufficient surface area to secure the attachment point in the workspace allotted. In other words, a very short vertical dimension, or horizontal dimension, would not allow the installer sufficient room to properly attached the connecting bracket 60, especially in tight workspaces.

Figure 1A:
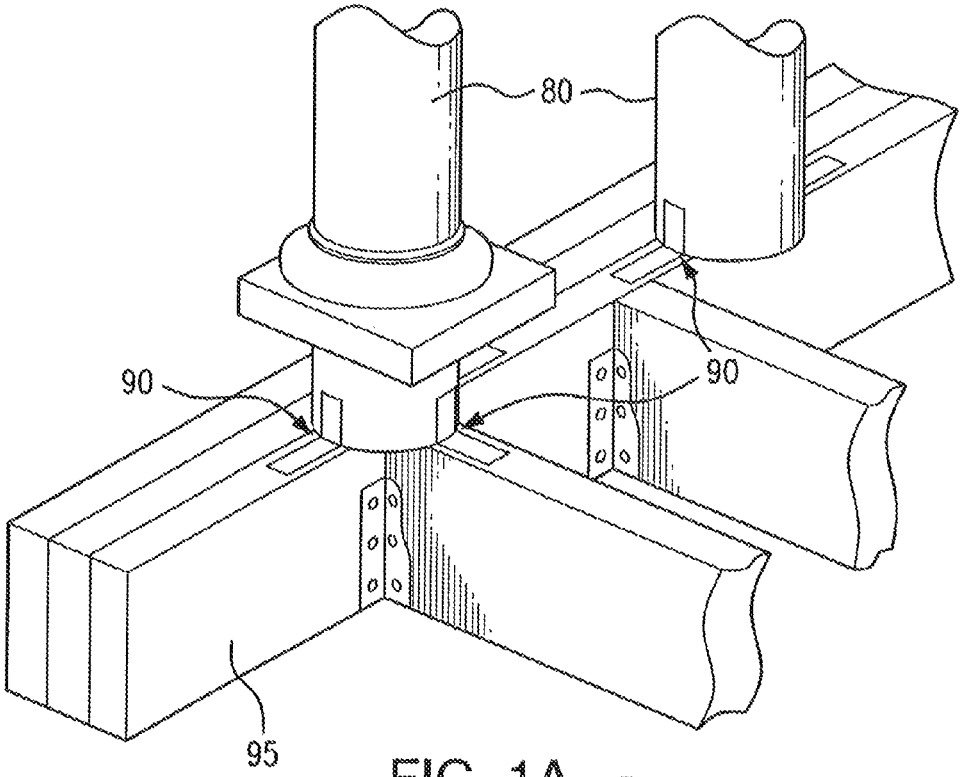
FIG. 1A PRIOR ART
FIG. 1A is a perspective view of a conventional system for connecting a column to a structural member employing "L" brackets.
Figure 1B:
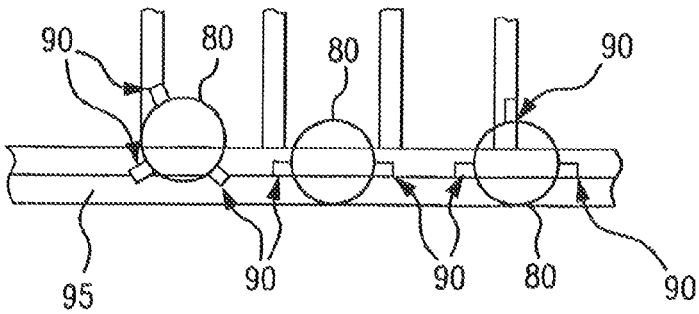
FIG. 1B PRIOR ART
FIG. 1B is a plan view of the installation in FIG. 1A.
Figure 2:
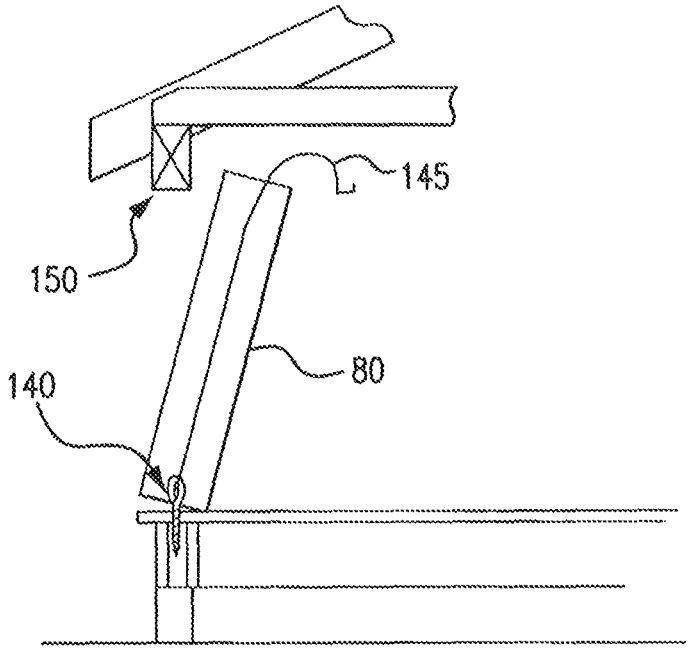
FIG. 2 PRIOR ART
FIG. 2 is a side view of a different conventional system for connecting a column to a structural member.

In still another embodiment, the present invention may be used to more effectively secure a hollow column to an attachment point, especially where the attachment point presents an offset load. As described previously in FIG. 2, a wire, strap or an all-thread long bolt 145 is typically threaded through the hollow column 80 for attachment at one or both ends to a structural attachment point. FIG. 3 illustrates a load condition found in many point load bearing designs, and therefore the need for an offset loading attachment is of great importance. FIG. 3 depicts such an offset loading attachment, which facilitates transfer of the axial forces to centrifugal forces, and thereafter to the radial points of the hollow column.

Conventional systems focus on center load and symmetrical load bearing connections, not offset loads as described herein. These symmetrical loading examples have corresponding points exhibiting symmetry in a structural formula having equal parts on both halves of the hollow column. In addition, conventional systems require use of special tools, or precautionary techniques to prevent internal parts such as chains or cable loops from twisting or being compromised to their attachment points during installation. On the other hand, the embodiment described herein enables ease of installation with all threads and couplers. This sequence of all threads and couplers assists in the ease of installation providing a sense of continuity to components not visible during the assembly process.

Figure 9A:
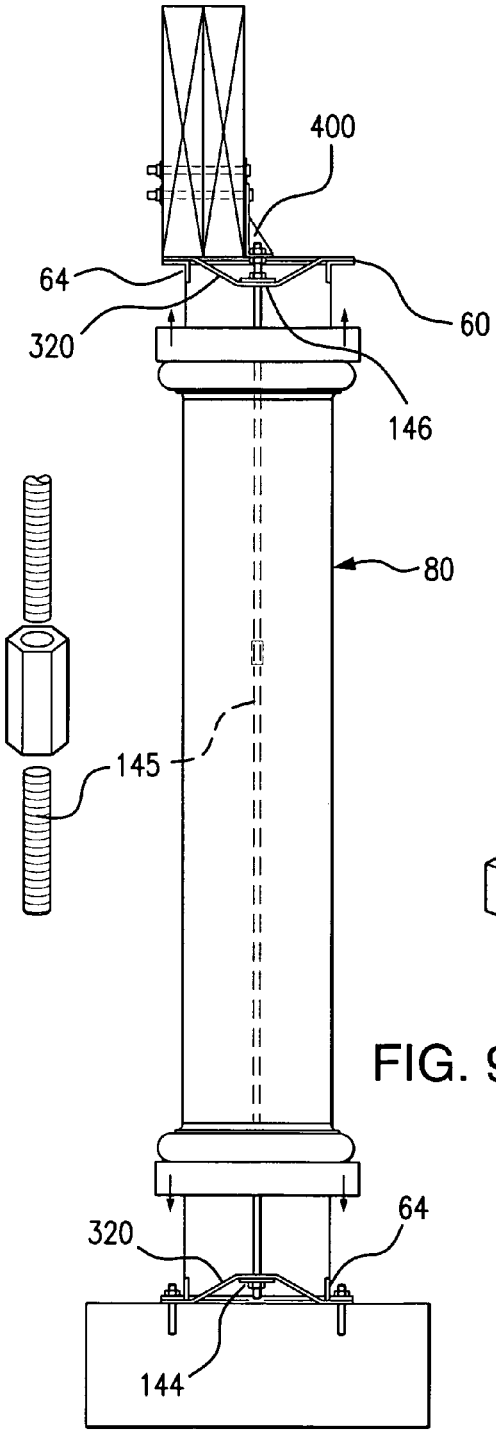
FIG. 9A is a partial cut-away side view showing the present invention employed with an inner hollow column attachment mechanism.
Figure 9B:
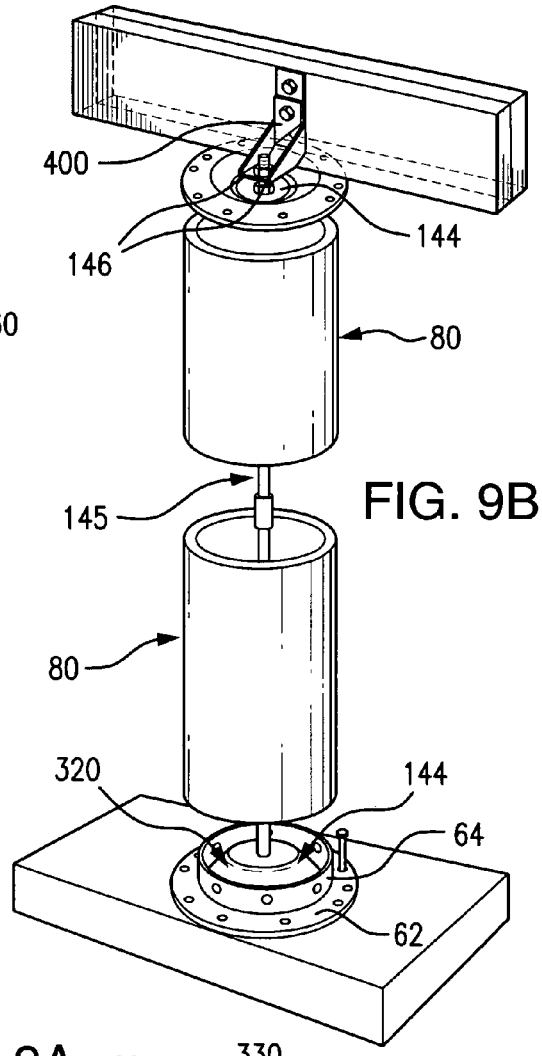
FIG. 9B is a top perspective view of the hollow column attachment mechanism of FIG. 9A.
Figure 9C:
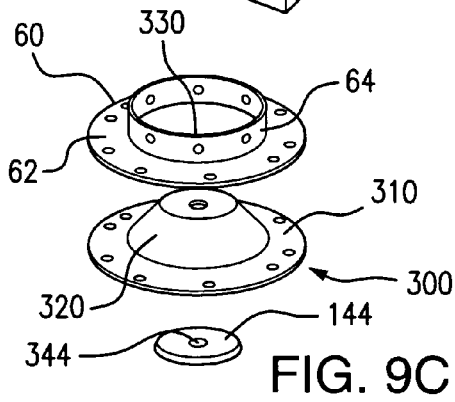
FIG. 9C is an exploded view of the three components that compress together to form a support-connecting unit.

FIGS. 9A, 9 B and 9 C illustrate an improved hollow column attachment mechanism for offset loads that employs the present invention. The offset load is transferred from the girder to the hollow column via an offset load transfer structure, such as an anchor down 400. A base support 300 comprises a peripheral rim 310 and an inverted-bowl or frustum-shaped central bevel 320.

The central bevel 310 has a flat apex surface which contains a bevel aperture 330, through which a mandatory reinforcing surface conforming washer 144, in conjunction with one or more tension members, which may comprise wire, strap, cable or all-thread long bolt 145 (see FIGS. 2, 9A and 9B) is threaded and secured through any conventional fastening means 146, such as a nut, wing nut, or any equivalent mechanicals tension member fasteners and couplers appurtenant to straps, cables, wires and all thread long bolts. The hollow column attachment mechanism 300 can be disposed at one or both ends of the hollow column 80, using appropriately sized identical components with inverted configurations, as shown in FIGS. 9A and 9B.

The peripheral rim 310 is initially secured by any conventional means to the attachment point by aligning the apertures disposed along the peripheral rim 310. Then the base plate 62 of the connecting bracket 60 is placed over the peripheral rim 310 to provide additional securing force, especially in areas of the country prone to high wind loading. Note that the column installer can secure the base plate 62 of the connecting bracket 60 over the peripheral rim 310 of the base support 300, and for additional securing force, also secure the socket 64 of the connecting bracket 60 to the hollow column 80. The peripheral rim 310 and the base plate 62 would be of like configuration, such as square, triangular, or octagon.

By spreading the load along and around the entire the circumference of the column, and providing a plurality of attachment points to thereby increase the shear connection, the present invention is also well suited for those circumstances where the center point load of a roof girder, for instance, is offset from the center point load of the columnar support.

While the present invention has been described in detail with reference to the preferred embodiments thereof, it should be understood to those skilled in the art that various changes, substitutions and alterations can be made hereto without departing from the scope of the invention as defined by the appended claims.

What is claimed is:

1. A system for attaching a columnar building member, having a top, a shaft and a base, to one or more structural support members, wherein the columnar building member is hollow and supports an offset load at the top, the system comprising:

a base connecting bracket, comprising a flat base plate and a socket;

wherein the base plate has an outer perimeter in the shape of a closed plane curve or a polygon and an inner perimeter in the shape of a closed plane curve or a polygon;

wherein the socket has an upper perimeter and a lower perimeter, which matches the shape and size of the inner perimeter of the base plate;

wherein the inner perimeter of the base plate is connected to the lower perimeter of the socket;

wherein the socket defines an interior socket cavity that conforms to the base of the columnar building member, such that the base of the columnar building member snugly fits within the socket cavity;

wherein a plurality of fastening means are disposed along the socket, whereby the base of the columnar building member is securely fastened to the base connecting bracket within the socket cavity;

wherein a plurality of fastening means are disposed along the base plate, whereby the base connecting bracket is securely fastened to the structural support member(s);

an offset load transfer structure which connects to top of the columnar building member to the offset load;

a base support, comprising a flat peripheral rim and a central bevel in the shape of a frustum or an inverted bowl, the central bevel having a flat apex surface with a bevel aperture;

a base reinforcing washer, comprising a flat washer disk having a washer aperture;

a series of one or more interconnected tension members having an upper distal end and lower proximal end;

one or more tension member couplers, which interconnect the tension members;

one or more mechanical tension member fasteners;

wherein a plurality of fastener apertures are disposed around the peripheral rim of the base support;

wherein the base support conforms to the base plate of the base connecting bracket, and the central bevel insertably fits within the socket cavity, such that the base connecting bracket fits over the base support to form a mated base support-connecting unit;

wherein the proximal end of the tension member(s) is secured by one or more tension member fasteners to the underside of the base reinforcing washer, and the tension member(s) extend(s) successively through the waster aperture, through the socket cavity, through the bevel aperture, and through the shaft of the columnar building member, and the distal end of the tension member(s) is secured by one or more tension member fasteners to the offset load transfer structure; and wherein the fastening means disposed along the base plate of the base connecting bracket extend through the fastening apertures of the peripheral rim of the base support and thereby secure the mated base support-connecting unit to the structural support member(s).

2. The system according to claim 1, further comprising:

a top connecting bracket having the inverted configuration of the base connecting bracket, wherein the socket cavity of the top connecting bracket conforms to the top of the columnar building member, such that the top of the columnar building member snugly fits within the socket cavity of the top connecting bracket;

a top support having the inverted configuration of the base support, wherein the peripheral rim of the top support conforms to the base plate of the top connecting bracket, and the central bevel of the top support insertably fits within the socket cavity of top connecting bracket, such that the top support fits over the top connecting bracket to form a mated top support-connecting unit;

a top reinforcing washer, comprising a flat washer disk having a washer aperture;

wherein the top reinforcing washer insertably fits over the flat apex surface of the central bevel of the top support; and wherein the distal end of the tension member(s) is secured by one or more tension member fasteners to the offset load transfer structure and the upper side of the top reinforcing washer, and the tension member(s) downwardly extend successively through the washer aperture of the top reinforcing washer, through the socket cavity of the top connecting bracket, through the bevel aperture of the top support, and through the shaft of the columnar building member, and the proximal end of the tension member(s) is secured to the base support-connecting unit.

* * * * *